US007697256B2

(12) United States Patent
Walker et al.

(10) Patent No.: US 7,697,256 B2
(45) Date of Patent: Apr. 13, 2010

(54) DIRECTING AEROSOL

(75) Inventors: Steven H. Walker, Vancouver, WA (US); Bradley B. Branham, Vancouver, WA (US); Bryan E. Robertson, Vancouver, WA (US); Suk Wong, Vancouver, WA (US); Kathleen Wettstein Harter, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 476 days.

(21) Appl. No.: 11/734,477

(22) Filed: Apr. 12, 2007

(65) Prior Publication Data

US 2008/0251596 A1 Oct. 16, 2008

(51) Int. Cl.
*B05B 5/053* (2006.01)

(52) U.S. Cl. ..... 361/226

(58) Field of Classification Search ..... 361/226
See application file for complete search history.

(56) References Cited

U.S. PATENT DOCUMENTS 3,515,064 A 6/1970 Vlier
3,757,803 A * 9/1973 Chiang ..... 131/188
4,338,613 A * 7/1982 Cruz-Uribe ..... 347/82
4,668,959 A 5/1987 Jochimsen et al.
4,912,489 A 3/1990 Schmidlin
5,095,322 A 3/1992 Fletcher
5,363,124 A 11/1994 Arway
5,434,609 A * 7/1995 Rhodes ..... 347/77
5,469,323 A * 11/1995 Kanayama ..... 361/225
5,774,141 A 6/1998 Cooper et al.
5,973,904 A * 10/1999 Pui et al. ..... 361/225
6,170,935 B1 1/2001 Wakahara et al.
6,257,709 B1 7/2001 Ueda
6,464,328 B1 10/2002 Hiramatsu et al.
6,758,555 B2 * 7/2004 Bajeux ..... 347/77
6,802,591 B2 10/2004 Takahashi
2003/0186131 A1 * 10/2003 Enloe ..... 430/5
2006/0181576 A1 8/2006 Endo et al.
2007/0285551 A1 * 12/2007 Noto ..... 348/335
2008/0035472 A1 * 2/2008 Lepage ..... 204/229.8
2009/0014646 A1 * 1/2009 Vakhshoori et al. ..... 250/296

FOREIGN PATENT DOCUMENTS

GB 2324765 A * 11/1998
JP 55002022 9/1980
JP 100116006 6/1998

* cited by examiner

*Primary Examiner*—Stephen W Jackson
*Assistant Examiner*—Ann T Hoang

(57) ABSTRACT

Embodiments of a system and method for directing aerosol are disclosed.

15 Claims, 3 Drawing Sheets

DIRECTING AEROSOL

BACKGROUND

Small particles of a substance that are suspended in the air or another medium are known as aerosol. In some applications, aerosol can become a problem where the particles accumulate in undesired areas over time. It would be desirable to prevent aerosol particles from accumulating in undesired areas.

DETAILED DESCRIPTION

In the following detailed description, reference is made to the accompanying drawings, which form a part hereof, and in which is shown by way of illustration specific embodiments in which the disclosed subject matter may be practiced. It is to be understood that other embodiments may be utilized and structural or logical changes may be made without departing from the scope of the present disclosure. The following detailed description, therefore, is not to be taken in a limiting sense, and the scope of the present disclosure is defined by the appended claims.

According to one embodiment, an electrostatic zone protection (EZP) system is provided. The EZP system includes three electrodes positioned to form a zone of protection from aerosol particles. The electrodes are biased to form Lorentz and Kelvin forces to direct charged and uncharged particles of the aerosol away from the zone of protection. A protected component may be placed in the zone of protection to prevent particles of aerosol from accumulating on or otherwise interfering with the protected component.

Figure 1A:
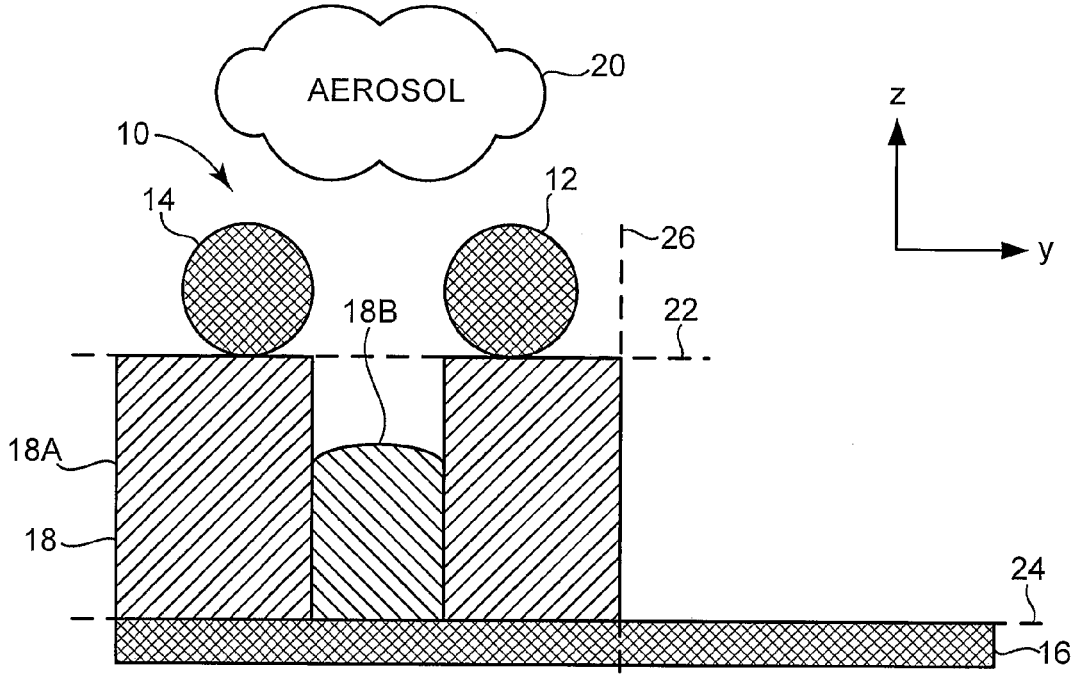
FIGS. 1A-1B are schematic diagrams illustrating a cross-sectional side view and a top view, respectively, of one embodiment of an electrostatic zone protection system.
Figure 1B:
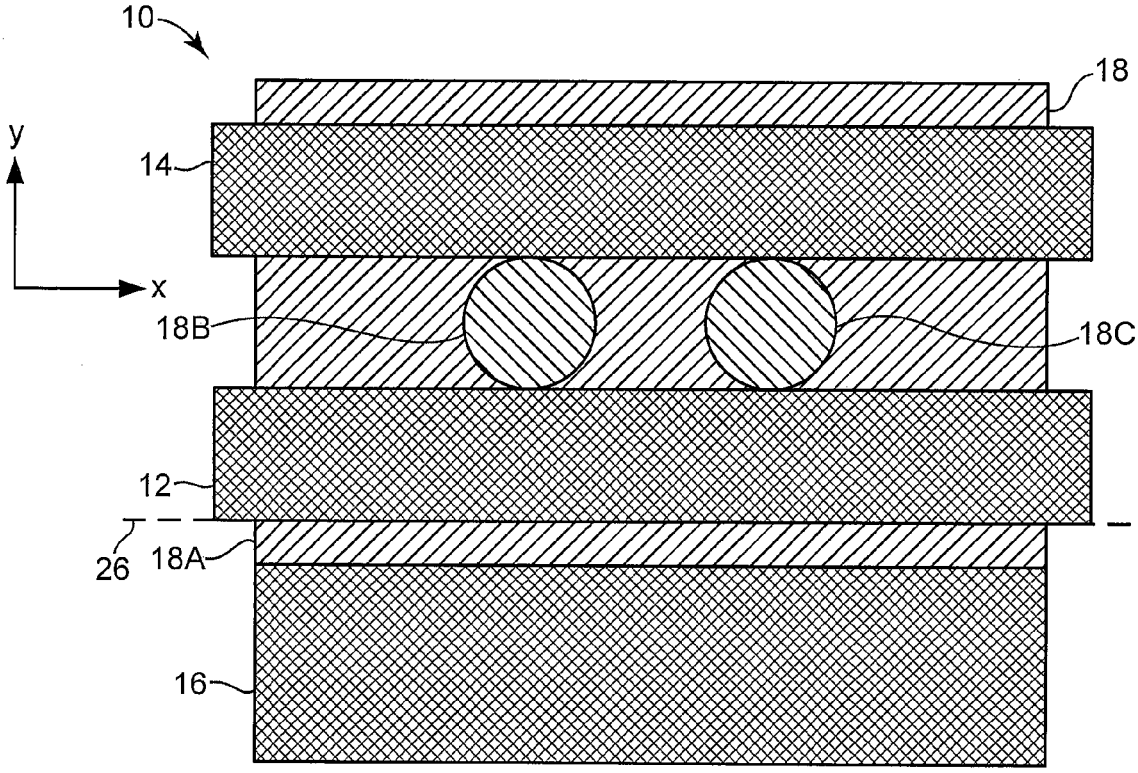

FIGS. 1A-1B are schematic diagrams illustrating a cross-sectional side view and a top view, respectively, of one embodiment of an electrostatic zone protection (EZP) system 10. EZP system 10 includes electrodes 12, 14, and 16 and a support apparatus 18. Support apparatus 18 includes a support member 18A and protected components 18B and 18C. EZP system 10 forms a zone of protection around protected components 18B and 18C to direct charged and uncharged particles from aerosol 20 away from protected components 18B and 18C.

The structural arrangement of EZP system 10 will now be described with reference to an xyz coordinate system as shown in FIGS. 1A-1B. Electrodes 12 and 14 are each conductive cylindrical members that are oriented in parallel on a plane 22 where plane 22 is parallel with the plane formed by the x and y axes. Electrodes 12 and 14 have equally sized, circular cross sections. In one particular embodiment, electrodes 12 and 14 are 2 millimeters in diameter and the centers of electrodes 12 and 14 are spaced 3-4 millimeters apart in the y direction. Electrode 16 is a plate or other planar electrode that is oriented in parallel with a plane 24 where plane 24 is parallel with plane 22 and the plane formed by the x and y axes and is offset from plane 22 in the z direction. In one particular embodiment, the offset between planes 22 and 24 is between one and ten millimeters.

Support apparatus 18 is configured to position electrodes 12 and 14 on plane 22 and electrode 16 on plane 24. Electrodes 12 and 14 are positioned on an upper surface of support member 18A where the upper surface forms a planar surface in plane 22. Electrodes 12 and 14 extend beyond protected components 18B and 18C in the x-direction by any suitable amount. In one particular embodiment, electrodes 12 and 14 extend protected components 18B and 18C by a distance greater than three times the distance between electrodes 12 and 14 in the y direction as shown in FIG. 1B. Electrodes 12 and 14 are positioned on opposite sides of protected components 18B and 18C. Electrode 16 is positioned on a lower surface of support member 18A where the lower surface forms a planar surface in plane 24. Electrode 16 extends beyond a plane 26 in the y direction where plane 26 is parallel to the plane formed by the x and Z axes and intersects with an outer edge of electrode 12.

Support apparatus 18 is configured to position or otherwise support electrodes 12, 14, and 16 in any suitable way. For example, electrodes 12, 14, and 16 may each be mounted on support apparatus 18 with one or more mounting fixtures (not shown), integrally formed with support apparatus 18, adhered or affixed to support apparatus 18, or placed within recessed areas of support apparatus 18. Support apparatus 18 may, in turn, be mounted, attached, affixed, or otherwise placed within a housing or support member of a larger system (not shown) such as an inkjet printer or other device which produces aerosol 20.

Support member 18A may be any suitable combination of one or more members or components that are formed from any suitable dielectric material or combination of materials. Protected components 18B and 18C may be any type of components positioned in the zone of protection formed by system 10. Support member 18A houses protected components 18B and 18C such that protected components 18B and 18C are each recessed from the upper surface of support member 18A in the z direction.

Aerosol 20 includes charged and/or uncharged particles that are suspended above and about EZP system 10. As used herein, the term charged particles refers to particles in aerosol 20 that have a net charge. The term uncharged particles refers to particles in aerosol 20 that do not have a net charge but may have constituents which, in aggregate, are polarizable. Uncharged particles include uncharged electrolytic particles and other solvated polarizable particles.

Depending on the application, aerosol 20 may be suspended in air or in another gaseous medium. In embodiments where EZP system 10 is used in an inkjet printer 50 (shown in FIG. 3), for example, aerosol 20 includes ink particles ejected from one or more printheads 53 (shown in FIG. 3) where the ink particles are comprised primarily of a solvent (e.g., water), dissolved dye or suspended pigments, and salt. In other embodiments, aerosol 20 may include other types of particles from one or more other sources.

In the embodiment of FIGS. 1A-1B, components 18B and 18C form the emitter and detector lenses, respectively, of a low-on-ink detector in an inkjet printer. In other embodiments, components 18B and 18C may be any other type of component in another system that is to be protected from aerosol 20.

In other embodiments, electrodes 12 and 14 may each have other types of cross sections such as hemispherical, polygonal, or other suitable cross sections that may or may not be equally sized. In addition, electrodes 12 and 14 may terminate prior to one or both edges the upper surface of support member 18A in the x direction in other embodiments.

In other embodiments, electrode 16 may be non-planar and may be formed with any suitable cross section. In addition, electrode 16 may be positioned above or in plane 22 in other embodiments. In these embodiments, electrode 16 is formed and positioned such that electrode 16 is separated from electrode 12 by some distance in the y direction.

In other embodiments, protected components 18B and 18C are separate from support member 18A and may be positioned relative to electrodes 12, 14, and 16 independently of support member 18A. Similarly, components 18B and 18C may be even with (i.e., flush with the top surface of support apparatus 18) or above the plane formed by the uppermost surface of support apparatus 18 in other embodiments.

To prevent particles from aerosol 20 from accumulating on or otherwise interfering with protected components 18B and 18C, electrodes 12, 14, and 16 are biased to form Lorentz and Kelvin forces that direct charged and uncharged particles of aerosol 20 away from protected components 18B and 18C. Electrodes 12,14, and 16 are biased to create a first potential difference between electrodes 12 and 14 and a second potential difference between electrodes 12 and 16. To create the first and the second potential differences, electrode 12 is biased to a first potential, electrode 14 is biased to a second potential, and electrode 16 is biased to a third potential. The first and the second potential differences may be equal or unequal, depending on the embodiment. The first and second potential differences create the Lorentz and Kelvin forces that direct charged and uncharged particles of aerosol 20 away from protected components 18B and 18C.

Electrodes 12 and 14 are positioned relative to protected components 18B and 18C so that a potential difference between electrodes 12 and 14 forms an electric field that directs charged particles 20A and 20B of aerosol 20 away from protected components 18B and 18C. Electrodes 12 and 16 are positioned relative to protected components 18B and 18C so that a potential difference between electrodes 12 and 16 forms a gradient of the electric field that directs uncharged particles 20C of aerosol 20 away from protected components 18B and 18C.

Figure 2A:
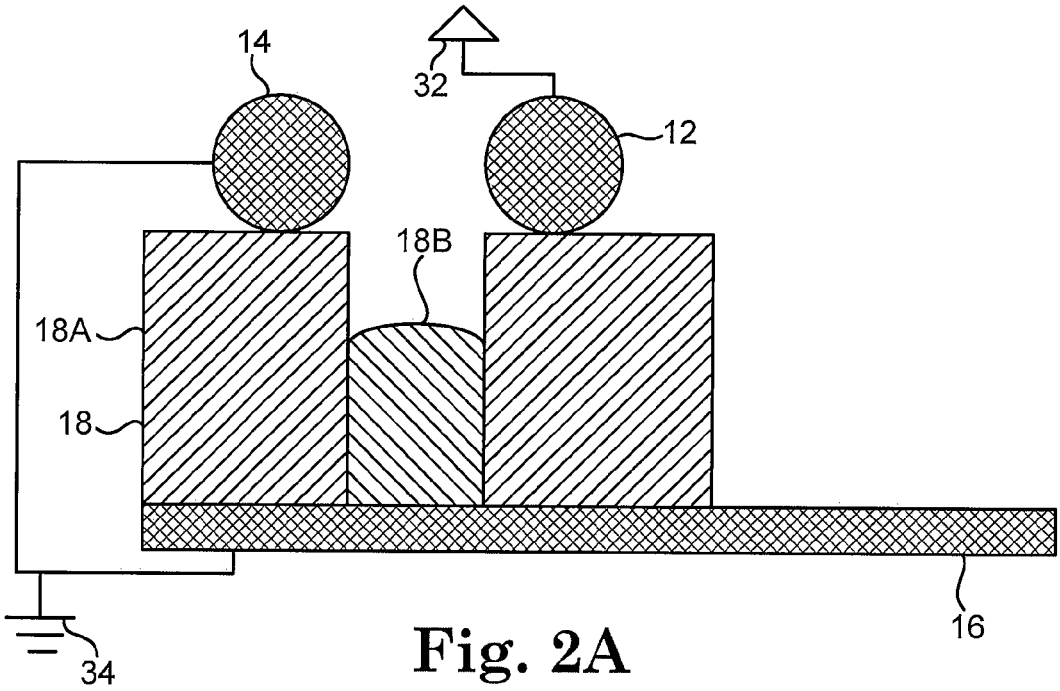
FIGS. 2A-2B are schematic diagrams illustrating one embodiment of biasing an electrostatic zone protection system.
Figure 2B:
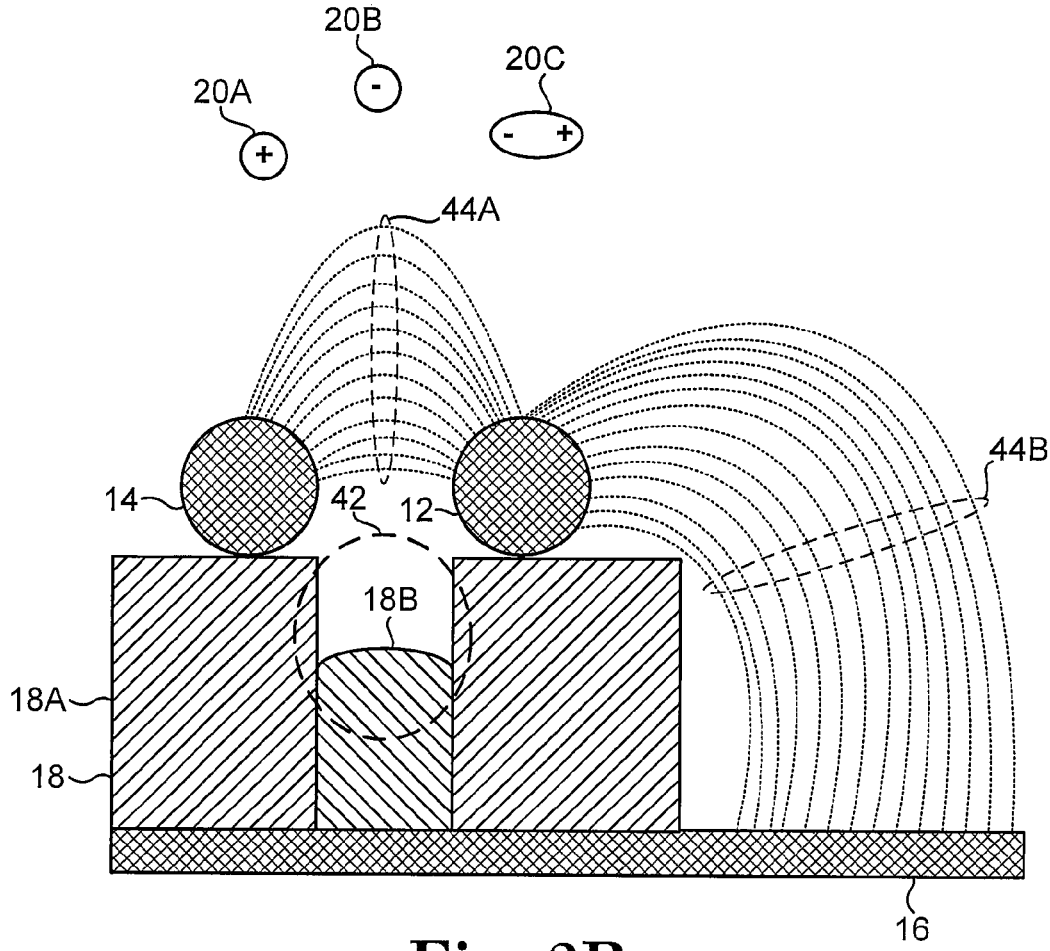

FIGS. 2A-2B are schematic diagrams illustrating the biasing of electrodes 12,14, and 16 and a zone of protection 42 that results from the biasing according to one embodiment. As shown in FIG. 2A, electrode 12 is connected to a voltage source 32 to bias electrode 12 at a first potential (i.e., a positive or negative voltage). Electrodes 14 and 16 are connected to a ground connection 34 to bias electrodes 14 and 16 at a second potential (i.e., zero volts). Accordingly, a potential difference equal to the voltage provided by voltage source 32 is created between electrodes 12 and 14 and between electrodes 12 and 16. This potential difference is set to be large enough (e.g., 400 V) to provide sufficient Lorentz and Kelvin forces to direct aerosol particles away from a zone of protection 42. The Lorentz and Kelvin forces prevent aerosol particles from impinging or coming to rest in zone of protection 42.

The potential differences between electrodes 12 and 14 and between electrodes 12 and 16 forms an electric field as shown in FIG. 2B. The electric field provides Lorentz forces that operate on charged particles (e.g., charged particles 20A and 20B) and Kelvin forces that operate on uncharged particles (e.g., particle 20C) to direct the particles away from zone of protection 42. A portion of the Lorentz force lines 44A between electrodes 12 and 14 and a portion of the Lorentz force lines 44B between electrodes 12 and 16 are illustrated in FIG. 2B.

The Lorentz and Kelvin forces that operate in EZP system 10 will now be described in additional detail.

The Lorentz force density is the electrical body force, $\vec{F}_L$, due to an electric field, $\vec{E}$, which acts on an individual charged constituent of aerosol 20, as shown in Equation I, where $\rho_p^{(e)}$ represents the net unbound charge of a particle.

$$\vec{F}_L=\rho_p^{(e)}\vec{E} \qquad \text{Equation I}$$

The Lorentz Law states that the macroscopic force acting on a charged aerosol particle is the aggregate sum of all coulomb forces acting on individual charges as shown in Equation II.

$$\vec{F}_L=\rho_e\vec{E}+\vec{J}\times\mu_0\vec{H} \qquad \text{Equation II}$$

In Equation II, $\rho_e$ is the net macroscopic charge density of charged aerosol particle 20A or 20B, $\vec{J}$ is the current density, $\mu_0$ is the magnetic permeability of free space, and $\vec{H}$ is the magnetic field. This can be viewed as the charges that do not cancel out in the microscopic summation of coulomb forces.

Assuming that the energy of the magnetic field is small relative to the energy of the electric field, then the net macroscopic force acting on the net charge density is described by Equation III where e=1.6 E-19 Coulombs.

$$\|F_L\|=\rho_e\|\vec{E}\|=\pm neE \qquad \text{Equation III}$$

The Kelvin force density, $\vec{F}_K$, due to the polarized elements of the electrolyte interacting with a non-uniform electric field, is the electrical body force which acts on both the individual uncharged and charged particles 20A, 20B, and 20C as described in Equation IV.

$$\|\vec{F}_K\| = 3\varepsilon_0 V_p\left(\frac{\kappa_g(\kappa_p-\kappa_g)}{2\kappa_g+\kappa_p}\right)\frac{1}{2}\nabla\|\vec{E}\|^2 \qquad \text{Equation IV}$$

In Equation IV, $\epsilon_0$ is the permittivity of free space, $V_p$ is the volume of the aerosol particle that is immersed in the electric field, $\kappa_g$ is the dielectric constant of the carrier gas, and $\kappa_p$ is the dielectric constant of the aerosol particle. An aerosol particle 20A, 20B, or 20C, which may be comprised of electrolytic constituents, in a non-uniform electric field has a net macroscopic force acting on the dipole moments contained as described by Equation V where $\vec{P}$ is the polarization vector of the aerosol particle.

$$\vec{F}_K=\vec{P}\cdot\nabla\vec{E} \qquad \text{Equation V}$$

Assuming a linear polarization constitutive law and that the diameter of an aerosol particle is constant, Equation VI may be derived where $d_p$ is the diameter of the particle.

$$\vec{P}=f(\kappa_p,\kappa_g,d_p)\vec{E} \qquad \text{Equation VI}$$

Combining Equations V and VI and applying various vector identities, Equation VII may be derived.

$$\vec{F}_K = \frac{1}{2}f(\kappa_p,\kappa_g,d_p)\nabla\left[\vec{E}\cdot\vec{E}\right]-\frac{1}{2}\vec{E}\cdot\vec{E}\nabla f(\kappa_p,\kappa_g,d_p) \qquad \text{Equation VII}$$

The first term in Equation VII expresses a body force, and the second term in Equation VII expresses a pressure.

From the above Equations, the Lorentz and Kelvin forces of EZP system 10 may be adjusted by adjusting the size, geometry, and orientation of electrodes 12, 14, and 16, by adjusting the strength and gradient of the electric field formed by electrodes 12,14, and 16, and by adjusting the dielectric properties of support apparatus 18. These variables of electrodes 12, 14, and 16 and support apparatus 18 may be adjusted as needed for an application to account for size, velocity, and charge distribution of the particles in aerosol 20.

Figure 3:
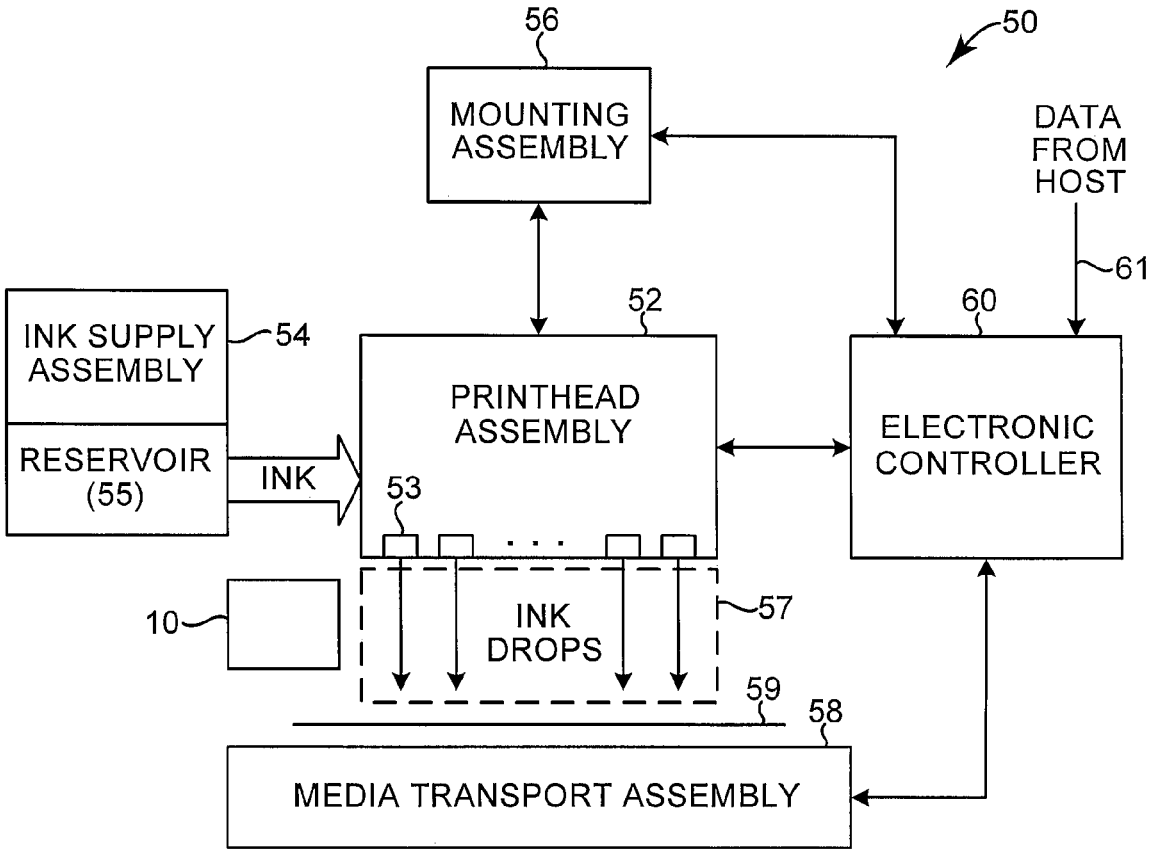
FIG. 3 illustrates one embodiment of an inkjet printing system that includes an electrostatic zone protection system.

FIG. 3 illustrates one embodiment of an inkjet printing system 50 that includes EZP system 10. Inkjet printing system 50 constitutes one embodiment of a fluid ejection system which includes a fluid ejection assembly, such as an inkjet printhead assembly 52, and a fluid supply assembly, such as an ink supply assembly 54. In the illustrated embodiment, inkjet printing system 50 also includes a mounting assembly 56, a media transport assembly 58, and an electronic controller 60.

Inkjet printhead assembly 52, as one embodiment of a fluid ejection assembly, includes one or more printheads or fluid ejection devices which eject drops of ink or fluid through a plurality of orifices or nozzles 53. In one embodiment, the drops are directed toward a medium, such as print medium 59, so as to print onto print medium 59. Print medium 59 is any type of suitable sheet material, such as paper, card stock, transparencies, Mylar, fabric, and the like. Typically, nozzles 53 are arranged in one or more columns or arrays such that properly sequenced ejection of ink from nozzles 53 causes, in one embodiment, characters, symbols, and/or other graphics or images to be printed upon print medium 59 as inkjet printhead assembly 52 and print medium 59 are moved relative to each other.

Ink supply assembly 54, as one embodiment of a fluid supply assembly, supplies ink to inkjet printhead assembly 52 and includes a reservoir 55 for storing ink. As such, in one embodiment, ink flows from reservoir 55 to inkjet printhead assembly 52. In one embodiment, inkjet printhead assembly 52 and ink supply assembly 54 are housed together in an inkjet or fluid-jet cartridge or pen. In another embodiment, ink supply assembly 54 is separate from inkjet printhead assembly 52 and supplies ink to inkjet printhead assembly 52 through an interface connection, such as a supply tube.

Mounting assembly 56 positions inkjet printhead assembly 52 relative to media transport assembly 58 and media transport assembly 58 positions print medium 59 relative to inkjet printhead assembly 52. Thus, a print zone 57 is defined adjacent to nozzles 53 in an area between inkjet printhead assembly 52 and print medium 59. In one embodiment, inkjet printhead assembly 52 is a scanning type printhead assembly and mounting assembly 56 includes a carriage for moving inkjet printhead assembly 52 relative to media transport assembly 58. In another embodiment, inkjet printhead assembly 52 is a non-scanning type printhead assembly and mounting assembly 56 fixes inkjet printhead assembly 52 at a prescribed position relative to media transport assembly 58.

Electronic controller 60 communicates with inkjet printhead assembly 52, mounting assembly 56, and media transport assembly 58. Electronic controller 60 receives data 61 from a host system, such as a computer, and may include memory for temporarily storing data 61. Data 61 may be sent to inkjet printing system 50 along an electronic, infrared, optical or other information transfer path. Data 61 represents, for example, a document and/or file to be printed. As such, data 61 forms a print job for inkjet printing system 50 and includes one or more print job commands and/or command parameters.

In one embodiment, electronic controller 60 provides control of inkjet printhead assembly 52 including timing control for ejection of ink drops from nozzles 53. As such, electronic controller 60 defines a pattern of ejected ink drops which form characters, symbols, and/or other graphics or images on print medium 59. Timing control and, therefore, the pattern of ejected ink drops, is determined by the print job commands and/or command parameters. In one embodiment, logic and drive circuitry forming a portion of electronic controller 60 is located on the inkjet printhead assembly 52. In another embodiment, logic and drive circuitry forming a portion of electronic controller 60 is located off the inkjet printhead assembly 52.

EZP system 10 may be mounted or otherwise positioned in inkjet printing system 50 to direct aerosol particles generated by nozzles 53 away from a zone of protection of EZP system 10.

Although specific embodiments have been illustrated and described herein for purposes of description of the embodiments, it will be appreciated by those of ordinary skill in the art that a wide variety of alternate and/or equivalent implementations may be substituted for the specific embodiments shown and described without departing from the scope of the present disclosure. Those with skill in the art will readily appreciate that the present disclosure may be implemented in a very wide variety of embodiments. This application is intended to cover any adaptations or variations of the disclosed embodiments discussed herein. Therefore, it is manifestly intended that the scope of the present disclosure be limited by the claims and the equivalents thereof.

What is claimed is:

1. An apparatus comprising:

a first electrode biased at a first potential;

a second electrode biased at a second potential; and a third electrode biased at a third potential;

wherein the first and the second electrodes are positioned on opposite sides of a component so that a difference between the first and the second potential forms an electric field that directs charged particles of an aerosol away from the component, and wherein the first and the third electrodes are positioned relative to the component so that a difference between the first and the third potential forms a gradient of the electric field that directs uncharged particles of the aerosol away from the component.

2. The apparatus of claim 1 wherein the first potential is a non-zero voltage, and wherein the second and the third potentials are zero.

3. The apparatus of claim 1 further comprising:

a voltage source configured to bias the first electrode at the first potential; and a ground connection configured to bias the second electrode at the second potential and the third electrode at the third potential.

4. The apparatus of claim 1 wherein the first and the second electrodes are positioned in parallel on a first plane.

5. The apparatus of claim 4 wherein the third electrode is positioned on a second plane that is parallel to and offset from the first plane.

6. The apparatus of claim 1 wherein the first and the second electrodes each have a circular cross section.

7. The apparatus of claim 1 wherein the third electrode is a plate.

8. The apparatus of claim 1 further comprising:

a support member configured to position the first, the second, and the third electrodes.

9. The apparatus of claim 8 wherein the support member is configured to position the component.

10. A method comprising:

biasing a first electrode at a first potential; and biasing a second electrode at a second potential to form an electric field between the first and the second electrodes that directs charged particles of an aerosol away from a zone of protection, and the first and the second electrodes positioned on opposite sides of the zone of protection; and biasing a third electrode at a third potential to form a gradient of the electric field that directs uncharged particles of the aerosol away from the zone of protection.

11. The method of claim 10 wherein the second potential is equal to the third potential.

12. The method of claim 10 further comprising:

biasing the first electrode by connecting the first electrode to a voltage source; and biasing the second and the third electrodes by connecting the second and the third electrodes to a ground connection.

13. The method of claim 10 further comprising:

positioning the first and the second electrodes in parallel on a first plane.

14. The method of claim 13 further comprising:

positioning the third electrode on a second plane that is parallel to the first plane.

15. The method of claim 14 wherein the second plane is offset from the first plane.

* * * * *

UNITED STATES PATENT AND TRADEMARK OFFICE

CERTIFICATE OF CORRECTION

PATENT NO. : 7,697,256 B2
APPLICATION NO. : 11/734477
DATED : April 13, 2010
INVENTOR(S) : Steven H. Walker et al.

It is certified that error appears in the above-identified patent and that said Letters Patent is hereby corrected as shown below:

In column 7, line 8, in Claim 10, after "protection," delete "and".

Signed and Sealed this

Tenth Day of August, 2010

David J. Kappos

David J. Kappos
*Director of the United States Patent and Trademark Office*